US005934962A

United States Patent [19]

Daum et al.

[11] Patent Number: 5,934,962

[45] Date of Patent: Aug. 10, 1999

[54] SHALLOW DRAFT SURFBOARD FIN MOUNT

[76] Inventors: Terry R. Daum, 33212 Carribbean Way, Dana Point, Calif. 92629; Mel Ross, 34822 Camino Capistrano, Capistrano Beach, Calif. 92624

[21] Appl. No.: 09/009,496

[22] Filed: Jan. 20, 1998

[51] Int. Cl.[6] ..... B63B 3/38; B63B 1/00

[52] U.S. Cl. ..... 441/79; 114/140

[58] Field of Search ..... 441/74, 79; 114/140, 114/357; 156/293

[56] References Cited

U.S. PATENT DOCUMENTS

| | | | |
|---|---|---|---|
| 3,422,471 | 1/1969 | Morey et al. | 441/79 |
| 4,379,703 | 4/1983 | Mizell | 441/79 |
| 4,804,347 | 2/1989 | Ross | 441/79 |
| 5,215,488 | 6/1993 | Bailey | 441/79 |
| 5,830,025 | 11/1998 | Fleming | 441/79 |

*Primary Examiner*—Sherman Basinger
*Assistant Examiner*—Patrick Muldoon
*Attorney, Agent, or Firm*—John J. Murphey

[57] ABSTRACT

In a surfboard of the type including spaced-apart top and bottom surfaces and an elongated recess formed therebetween for removably anchoring the base of a surfboard fin therein, a shallow draft surfboard fin socket for location in the recess in bonded engagement therewith including an elongated housing including a narrow bottom wall, spaced-apart upstanding elongated side walls, and spaced-apart upstanding short front and rear end walls, all joined together along their intersecting marginal edges to form an elongated cavity configured to receive therein the base of the fin, a flange extending outward from the side and end walls for location between the top and bottom surfboard surfaces, the housing side and end walls extending above the flange a distance sufficient to locate the upper marginal edges of the walls above the bottom surface of the surfboard and, first and second recesses formed in the front and rear housing walls respectively, interior the cavity, for receipt therein of a protrusion, formed at the front of the fin base, and a notch, formed at the rear of the fin base, for receipt therein of a clip to hold the fin in the cavity.

20 Claims, 3 Drawing Sheets

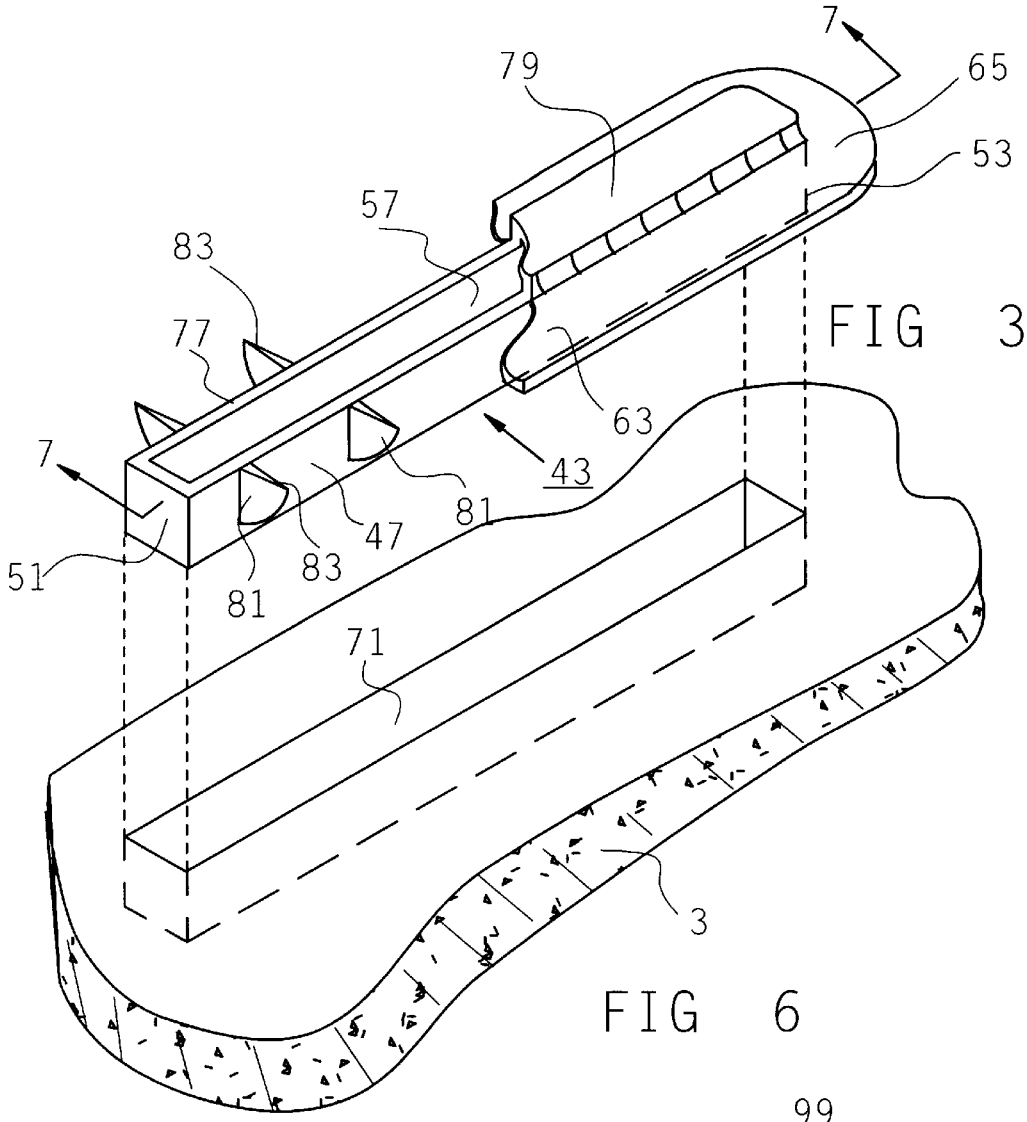
FIG 3
FIG 6
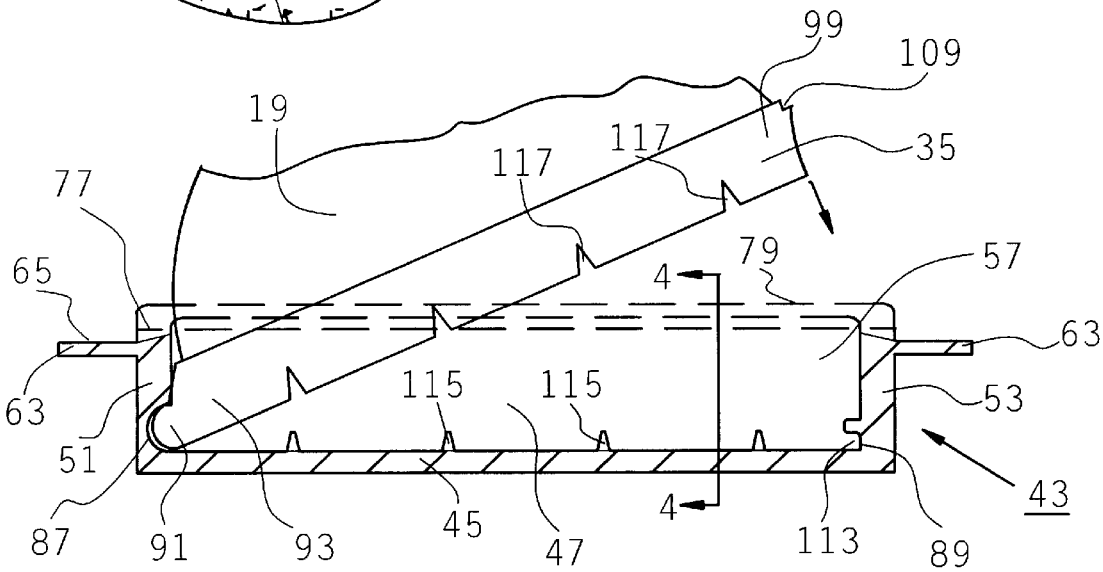
FIG 7

SHALLOW DRAFT SURFBOARD FIN MOUNT

BACKGROUND OF THE INVENTION

1. Field of the Invention

This invention pertains to the field of surfboard construction. More particularly, the invention concerns a unique shallow draft surfboard fin socket for location in a recess formed in the bottom surface of a surfboard.

2. Description of the Prior Art

Much has been written about surfboards, the long, plank-like devices that young people use as a vehicle to ride on the top of incoming waves. While surfboards take on a variety of sizes and shapes, they generally can be defined as consisting of a length of foam as a core, defined by elongated curved sides, a generally pointed front end and a round or blunt rear end, where the broad top and bottom surfaces are spaced-apart, the top surface used to support the body of the rider, while the bottom surface contains fins that act as rudders to help in directing the board over the water. Current practice is to cover the foam core with at least one layer of curable resin-impregnated fiber material, such as glass fiber matting, and finish the board to a high gloss with one or more layers of a gel coat.

The fins extending from the bottom surface of the surfboard down into the water over which the board is passed are generally thin with sharp marginal edges and extend outward from the board from a straight fin base. Depending upon the size, shape and style of the surfboard, there may be a single large fin or a plurality of smaller fins in spaced-apart arrangement for use in controlling the direction of travel of the board. To insure that the fins remain in strong attachment to the board and in rigid position therewith, the fin base is usually anchored in a fin socket that is anchored in the foam core of the board.

Fin sockets are of two general types. The first type is a fin socket anchored in the foam core in which the fin is removably mounted. The removability of the fin is in recognition of the difficulty to package a surfboard having the fins extending therefrom and further is in recognition of the dangerous character of extended fins as the board is swung or moved from a transport vehicle, such as an automobile, and carried through a busy beach to the ocean where numerous young people may be in crowded attendance. Some of these removable-type designs allow the fin to be moved and reset in an elongated fin mount, at the discretion of the user, to change the riding characteristics of the board. A metal fastener is used to hold the fin in position in the box.

The second type of socket is of the permanent variety where a box-like socket is first adhesively anchored in the core of the surfboard and has an outwardly opening slot in which the fin is inserted along with sufficient adhesive to make the joint therebetween of a permanent nature. This type of fin mounting does not permit adjustment of the fin in the socket or for removal of the fin for transport, movement through a crowd, or otherwise.

With respect to the removable-type fin mounting, complaints from surfboard manufacturers that the socket is too deep and thus adversely affects the strength, surface gloss and finish of the surfboard has spurred development of a shallow fin socket for removably holding the fin therein. The depth of the fin socket is thought to be important from the standpoint of providing sufficient bonding area between the fin anchor box and the foam. Efforts to make a shallower box have led to a loss of this anchoring surface with the result that the box becomes loose during use of the surfboard in rough water and allows the influx of sea water which further deteriorates the bonding therebetween and ultimately results in the loss of the fin.

One approach to making a shallower draft fin box is shown in U.S. Pat. No. 4,804,347 where the sides of the box are slanted outward to provide greater surface area of contact with the underlying foam core. This particular design has unwittingly created a pair of spaced-apart sealed air pockets in the housing that, upon exposure of the surfboard to sunlight, such as when the surfboard is carried upside down on the top of a vehicle, has caused air in these pockets to undergo expansion with the result that the foam is ruptured about the air pockets leading to destruction of the joint between the fin socket and the surfboard. In addition, in this particular design, glass overlying external ribs formed in the top surface of the housing does not bend appropriately enough about the attachment ribs thereby allowing the formation of air bubbles thereunder which often expand during this heating process and make open holes in the bottom of the board thus allowing the influx of sea water and the accompanying damage created thereby. In all situations, where the fin is permanently attached to the bottom of the board, should the fin encounter an obstruction during use of the surfboard, the fin may undergo damage up to and including breakage that is not repairable and thus the surfboard owner suffers total loss as the result of damage to one or more fins.

Finally, where fins are removably attached to such anchor boxes, often the stress applied to the fin during use or upon the fin striking a solid object, is transmitted completely to the rear of the fin base thus applying significant stress to a small portion of the fin anchor box and raising the potential for the box to suffer damage such as cracking of the rear walls of the fin box and allowing the entrance of sea water, etc. In addition, all metal fixtures and fasteners suffer corrosion in sea water and require constant attention and/or replacement.

Accordingly, there exists a need for a shallow draft surfboard fin socket for use in surfboards to allow quick and easy removal and reinsertion of fins in the surfboard to accommodate a variety of situations during transportation, use and maintenance of the boards.

SUMMARY OF THE INVENTION

This invention is a surfboard fin socket having a very shallow draft vis-a-vis the prior art that solves the aforesaid problems with existing fin sockets. The invention comprises an elongated housing including a narrow bottom wall, spaced-apart upstanding elongated side walls and spaced-apart upstanding short front and rear end walls all joined together along their interconnecting marginal edges to form an elongated cavity configured to receive therein the base of the fin, a flange extending outward from the side and end walls for locating between the top and bottom surfboard surfaces, the flange preferably being planar and arranged parallel to the bottom wall and orthogonal to the housing walls. The housing side and end walls extend above the flange a distance sufficient to locate the upper marginal edges of the walls above the bottom surface of the surfboard and lie in a plane that is parallel to the bottom surface of the surfboard, and further including a cap formed over the upper marginal edges of the housing side, front and rear walls to enclose the cavity formed therein during construction of the surfboard and for later removal to open the cavity for receipt therein of the fin base. At least one, but preferably a plurality of, ribs extend outward between the side wall and the flange, exterior of the housing, and have a sharp, knife-edge formed on the free marginal edge thereof for pressing into the foam core of the surfboard to provide further anchoring power to the housing. First and second recesses are formed in the front and rear housing walls respectively, interior the cavity, for receipt therein of a protrusion formed at the front of the fin base, wherein the first recess formed in the front housing wall includes a rounded portion to allow the fin base to be inserted into the front of the cavity, rotated and pivoted downward into full receipt therein and a notch formed at the rear of the fin base for receipt therein along with a clip to hold the fin base temporarily in the cavity, and wherein the exterior flange is defined by a top surface and a bottom surface and the housing further includes a plurality of depressions formed in the top flange surface for receipt thereover of a layer of curable resin-impregnated fibers forming the bottom surface of the surfboard.

With this invention, the socket housing is extremely shallow so as to solve the problem concerning the claims of surfboard manufacturers that the anchor box was too deep. Further, there are no air pockets in this invention that will expand and cause the damage that the air pockets of other prior art devices have been alleged to have caused. There are no external top ribs in the flange but only depressions so as to prevent the creation of bubbles below the finish layer of curable resin-impregnated fiber mat. If the fin is damaged in any way or broken, it may easily be replaced with a new fin without causing damage to the surfboard itself. The fin is held in the housing by a clip that is made of plastic instead of metal so that the problems with corrosion are eliminated.

Finally, the compressive stress applied to the front of the fin during use is distributed along the bottom of the housing by the interaction of a plurality of teeth formed in the bottom socket housing wall that extend upward into the cavity and engage a plurality of like-spaced detents formed in the fin base.

Accordingly, the main object of this invention is a surfboard fin socket of shallow draft that does not cause the problems heretofore identified with the prior art. Other objects of the invention include a fin socket totally devoid of air pockets that heretofore have caused damage to the core of the surfboard; a fin socket where the top layer of curable resin-impregnated fiber mat is easily applied over the flange of the socket without also causing formation of undesirable voids and bubbles; a fin socket that allows removal of the fin for safety and to replace damaged fins without causing damage to the core of the surfboard; a surfboard fin socket wherein the compressive stress on the surfboard fin is translated to an average stress over the entire bottom wall of the surfboard fin socket housing; and, a surfboard fin socket allowing removable attachment of a surfboard fin to a surfboard without the use of metal anchors or other metal parts that are adversely affected by salt water.

These and other objects of the invention will become more apparent by reading the following Description of the Preferred Embodiment taken together with the drawings that are appended hereto. The scope of protection sought by the inventors may be gleaned from a fair reading of the claims that conclude this specification.

DESCRIPTION OF THE DRAWINGS

FIG. 3 is an isometric view, showing the top portion partially broken away, of the shallow draft surfboard fin socket of this invention;

FIG. 6 is an isometric view of a portion of the foam core of a typical surfboard showing the recess formed therein for receipt therein of the novel shallow draft surfboard fin socket of this invention;

FIG. 7 is a sectional view of the housing making up the shallow draft surfboard fin socket of this invention showing the insertion of the fin base therein taken along lines 7—7 in FIG. 3;

DESCRIPTION OF THE PREFERRED EMBODIMENT

Figure 1:
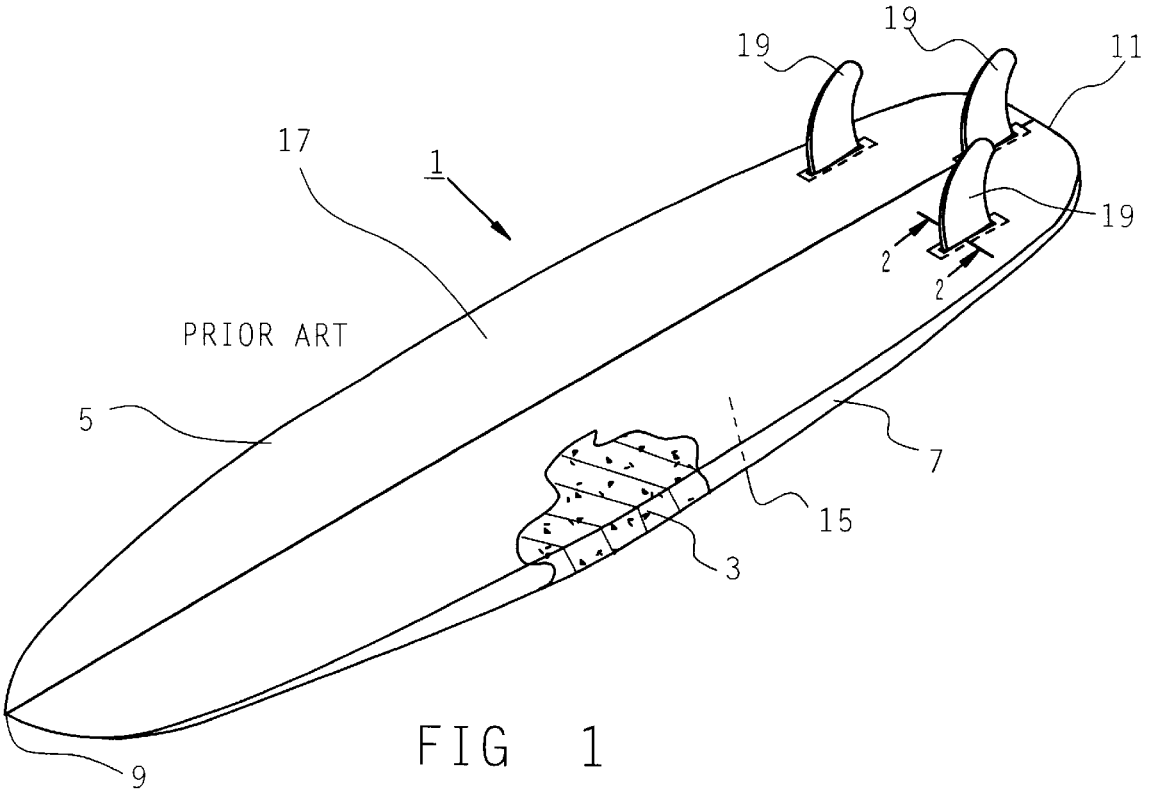
FIG. 1 is an illustrative view of a typical foam core surfboard in an upside down position showing the plurality of directional fins located at the aft or rear portion thereof.

Turning now to the drawings wherein elements are identified with numerals and like elements are identified with like numerals throughout the nine figures, FIG. 1 shows a typical surfboard 1 of this invention comprising a shape rigid plastic foam core 3 defined by spaced-apart curved side edges 5 and 7 that meet at a rather pointed front end 9 and at a blunt rear end 11. Core 3 is covered over with at least one layer of cured resin-impregnated fiber matting to form spaced-apart generally flat top surface 15 and bottom surface 17. As shown in FIG. 1 and as known in the prior art, typical surfboards contain at least one, but more often a plurality of fins 19 located on bottom surface 17 usually near rear end 11.

Figure 2:
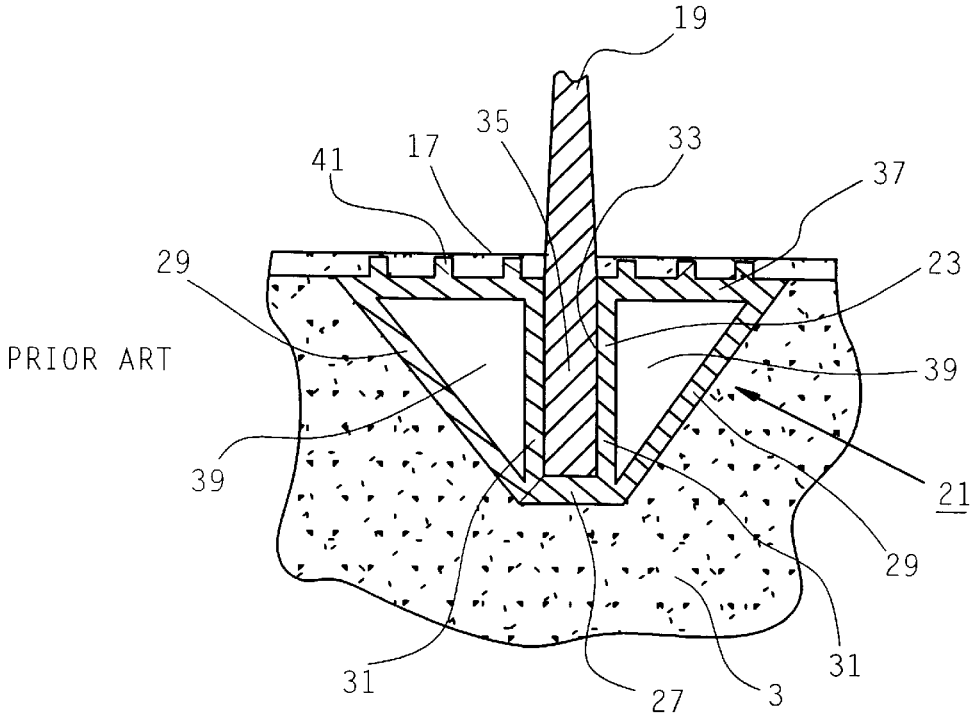
FIG. 2 is a sectional side view of a typical surfboard fin socket of the prior art.

As shown in FIG. 2, a typical surfboard fin socket 21 is located below bottom surface 17 in core 3 and generally comprises a housing 23 made up of a bottom wall 27 having a pair of outside side walls 29 slanting upward in an opening formed in core 3, and a pair of inside side walls 31 also extending up from bottom wall 27 vertically toward surfboard bottom surface 17 and forming a slot 33 therebetween for insertion of the base 35 of a typical fin 19, coated with adhesive (not shown) for connecting said inside walls 31 with fin base 35 in adhesive interconnection. Housing 23 is usually made of injection moldable plastic.

A flange 37 interconnects the upper extremity of outside side walls 29 with inside side walls 31 and contains a plurality of upwardly directed ribs 41 over which is laid a mat of curable resin-impregnated fibers, such as fiberglass, that forms a surfboard bottom surface 17. Between outside side walls 29 and inside side walls 31 is formed a pair of spaced-apart hollow chambers 39. It is these chambers that are disrupted by the expanding air carried therein when the bottom surface 17 of surfboard 1 is exposed to continuous heating through sunlight as is typical when the board is carried upside down on the roof of a motor vehicle.

Figure 4:
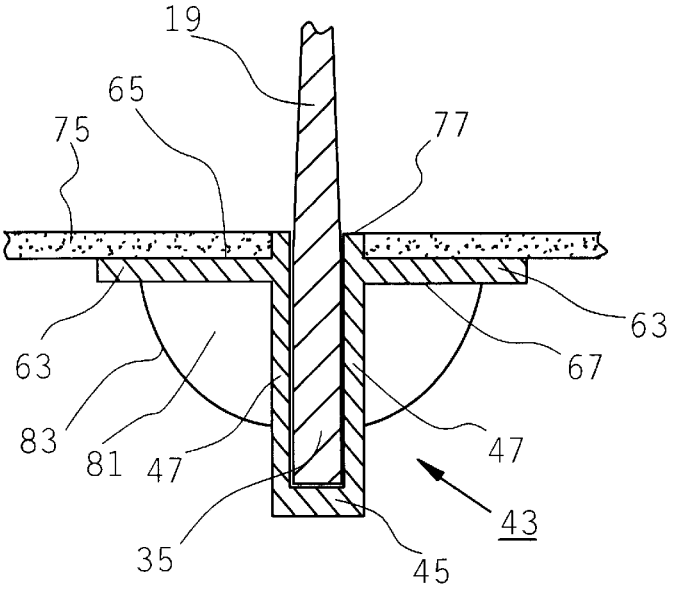
FIG. 4 is a sectional view, similar to that in FIG. 2, of the shallow draft surfboard fin socket of this invention.

The instant invention is shown in FIGS. 3, 4 and 7 to comprise an elongated housing 43 that includes a narrow bottom wall 45, a pair of spaced-apart upstanding elongated or wide side walls 47 and spaced-apart upstanding narrow front end wall 51 and rear end wall 53, all joined together along their intersecting marginal edges to form an elongated cavity 57 configured to receive therein the base 35 of a typical surfboard fin (see FIG. 4).

It is preferred that bottom housing wall 45 is planar in character. It is further preferred that bottom housing wall 45 be planar and said plane arranged parallel to surfboard bottom surface 17 so as to provide the greatest amount of support to surfboard fin 19.

Figure 5:
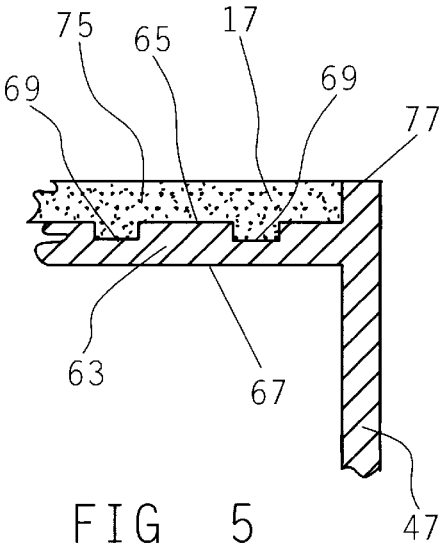
FIG. 5 is a closeup view of the bottom surface of resinimpregnated fibers overlaid the flange of this invention.

As shown in FIGS. 3, 4 and 5, a flange 63 extends outward from housing side walls 47 and front and rear end walls 51 and 53 for location within foam core 3 of surfboard 1. Preferably, flange 63 is planar in character and arranged orthogonal or perpendicular to housing side walls 47. Further, flange 63 is preferably defined by a top surface 65 and a spaced-apart bottom surface 67 wherein top flange surface 65 has a plurality of depressions 69 formed therein for receipt thereover of a layer 75 of curable resin-impregnated fibers that form bottom surface 17 of surfboard 1. The presence of depression 69 in the top surface of flange 63 is for the purpose of increasing the grip of the fiber mat over core 3 on housing 43. The interconnection of curable resin-impregnated fiber matting 75 with depression 69 in flange top surface 65 is shown in FIG. 5. Prior art upwardly extending ribs 41, in place of depression 69, have proven to be of little use and have been the site of numerous air holes and pin holes that have developed therein that weaken the overall connection between matting 75 and flange 63.

As shown in FIGS. 3, 4 and 7, housing side walls 47 and front and rear end walls 51 and 53 extend above flange 63 a distance sufficient to locate the finished upper marginal edges 77 of said walls above bottom surfboard surface 17. A cap 79 is initially molded over the entire upper marginal edges 77 and cavity 57, as shown in FIG. 3 and in dotted outline in FIG. 7, to enclose cavity 57 during construction of surfboard 1. During construction, after housing 43 is lowered into recess 71 (see FIG. 6) formed in foam core 3 by a router or other like equipment, a curable resin of a syrupy viscosity is poured over the upwardly facing surface of surfboard 17, whether it be top surface 15 or bottom surface 17, and squeegeed about the surface to spread the curable resin over the fiber matting to enclose core 3. During this activity, resin could seep down into cavity 57 were it left uncovered. Once housing 43 is seated in recess 71, it is incumbent upon the craftsperson to maintain cavity 57 clear of curable resin so that said cavity does not become clogged with drops or spills of cured resin.

Accordingly, cap 79 is initially molded over cavity 57 so that housing 43 is a sealed unit when placed in recess 71 (see FIG. 6). Later, after all the resin has cured, a belt sander or other similar device is used to grind or sand off cap 79 to expose cavity 57 in a pristine condition. In the preferred form of this invention, upper marginal edges 77 of housing side, front and rear walls are formed during this sanding operation and preferably arranged to lie above flange 63 in a plane. The height of marginal edges 77 are arranged to ultimately become planar and flush with surfboard bottom surface 17.

As shown in FIGS. 3 and 4, a rib 81 extends between the exterior of housing side walls 47 and flange bottom surface 67. These are singular ribs in that the slanted free outer marginal edge 83 of ribs 81 are formed as knife edges. A plurality of such ribs 81, each having a sharp slanted outer edge 83, is formed along housing side walls 47 for pressing into foam core 3 as housing 43 is lowered into recess 71 as shown in FIG. 6. Knife edges 83 slice into foam core 3 and act as gripping members in addition to the stabilizing action of flange 63, housing side walls 47, front and rear end housing walls 51 and 53 and bottom wall 43 when glued into position in recess 71. Such use of knife edged ribs eliminates the air pockets shown in FIG. 2 of the prior art so that heating of surfboard 1 through direct sunlight does not result in damage to either the surfboard core or housing 43.

As shown in FIG. 7, first and second recesses 87 and 89, respectively, are formed in housing front end wall 51 and rear end wall 53, respectively, interior cavity 57, for receipt therein of a protrusion 91 formed at the front end 93 of fin base 35. The purpose of protrusion 91 is to allow fin base 35 to be inserted at a slant into cavity 57 and protrusion 91 inserted in first recess 87 to allow the fin and fin base to be pivoted downward in rotational motion into full receipt into cavity 57. The direction of downward movement is shown by the arrow in FIG. 7.

Figure 8:
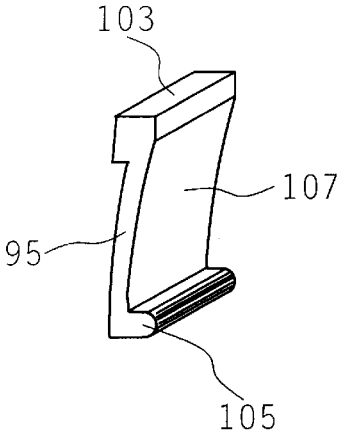
FIG. 8 is a closeup view of the Z-shaped clip of this invention.

Second recess 89 is formed in rear housing end wall 53 to accept a Z-shaped clip 95 in compact arrangement as shown in FIG. 8 to seat the rear end 99 of fin base 35 fully into cavity 57 and hold fin 19 tightly to surfboard 1. As shown in FIG. 8, Z-shaped clip 95 comprises a pair of spaced-apart short arms 103 and 105, respectively, each facing in opposite directions, said short arms 103 and 105 joined together by a slanted long section 107. Top short arm 103 is arranged for insertion in a notch 109 formed in the upper rear part of fin base 35 while bottom short arm 105 is arranged to slip into a notch 113 formed in the lower part of housing rear end wall 53. Upon joining Z-shaped clip 95 to the rear end 99 of fin base 35 and pivoting fin base 35 downward from front end 93, clip 95 locks fin base 35 into cavity 57.

Figure 9:
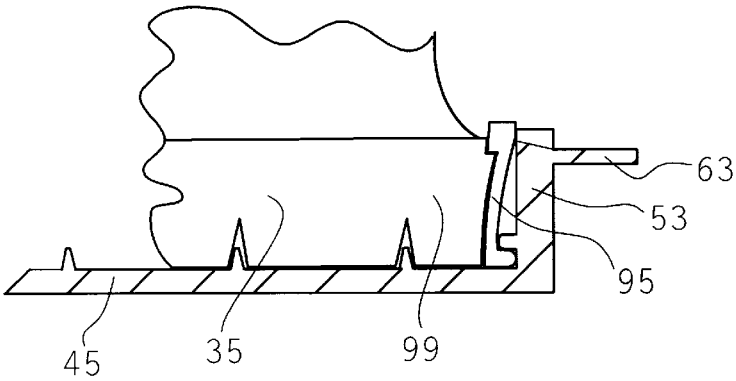
FIG. 9 is a closeup view of the rear portion of the fin base of this invention installed with the Z-shaped clip in the housing of the shallow draft surfboard fin socket of this invention.

As shown in FIGS. 7 and 9, housing bottom wall 45 forms at least one, but preferably a plurality, of upwardly directed toothshaped protrusions 115 that extend into the lower part of cavity 57 for receipt in complementary engagement with at least one, but preferably a plurality, of like-spaced notches 117 formed along the bottom surface of fin base 35 for complementary inter-engagement therewith. The purpose of protrusions 115 and notches 117 is to transfer stress received at the front of fin 19 through base 35 to said notches and into housing bottom wall 45 that is of substantially greater area than housing rear end wall 53. The stress applied to the fin from external sources is then translated into a shear force applied along the entire surface of housing bottom wall 45 that is then transferred to core 3. This reduces the high stress placed against rear end wall 53 of housing 43 and spreads it over a wider area.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same results are within the scope of this invention.

What is claimed is:

1. In a surfboard of the type including spaced-apart top and bottom surfaces and an elongated recess formed therebetween for removably anchoring the base of a surfboard fin therein, a shallow draft surfboard fin socket for location in said recess in bonded engagement therewith, comprising:

a) an elongated housing including a narrow bottom wall, spaced-apart upstanding wide side walls, and spaced-apart upstanding narrow front and rear end walls, all joined together along their interconnecting marginal edges to form an elongated cavity configured to receive therein the base of the fin;

b) a flange extending outward from said side and end walls for location between the top and bottom surfboard surfaces;

c) said housing side and end walls extending above said flange a distance sufficient to locate the upper marginal edges of said walls above the bottom surface of the surfboard;

d) first and second recesses formed in said front and rear housing walls respectively, interior said cavity, for receipt therein of a protrusion, formed at the front of the fin base, and a notch, formed at the rear of the fin base, for receipt therein of a clip to hold the fin base in said cavity; and, e) at least one upwardly directed tooth-shaped protrusion formed in said housing bottom wall for receipt in complementary element in a notch formed in the base of the fin to transfer forward and rearward applied stress on the fin to said housing and into the center of the surfboard.

2. The surfboard fin socket of claim 1 wherein said bottom housing wall is planar.

3. The surfboard fin socket of claim 1 wherein said bottom housing wall is arranged parallel to the bottom surface of the surfboard.

4. The surfboard fin socket of claim 1 wherein said flange is planar and arranged parallel to said bottom wall.

5. The surfboard fin socket of claim 1 wherein said flange is planar and is arranged orthogonal to said housing side walls.

6. The surfboard fin socket of claim 1 wherein said flange is planar and arranged parallel to said bottom wall and orthogonal to said housing side walls.

7. The surfboard fin socket of claim 1 wherein said upper marginal edges of said side, front and rear housing walls lie above the bottom surface of the surfboard and in a plane that is parallel to the bottom surface of the surfboard.

8. The surfboard fin socket of claim 7 further including a cap formed over said upper marginal edges of said housing side, front and rear walls to enclose said cavity formed therein during construction of the surfboard and for later removal to open said cavity for receipt therein of the fin base.

9. The surfboard fin socket of claim 1 wherein said first recess formed in said front housing wall includes a rounded portion to allow said fin base to be inserted into the front of said cavity and pivoted downward into full receipt therein.

10. The surfboard fin socket of claim 1 further including at least one rib extending outward between said side wall and flange, exterior said housing and having a knife edge formed on the free marginal edge thereof for pressing into the material forming the surfboard to further anchor said housing in the surfboard.

11. The surfboard fin socket of claim 1 wherein said second recess includes a notch for receipt of the rear terminal end of said fin base and a clip to be interconnected in compact arrangement therein to fix the base of the fin in said housing.

12. The surfboard fin socket of claim 1 including a plurality of spaced-apart upwardly directed tooth-shaped protrusions formed in said housing bottom wall for receipt in complementary engagement in a like plurality of spaced-apart indentations formed in the base of the fin to transfer forward and rearward applied stress on the fin to said housing and into the center of the surfboard.

13. The surfboard fin socket of claim 1 wherein said flange is defined by a top surface and a bottom surface and said housing further includes a plurality of depressions formed in said flange top surface for receipt thereover of a layer of curable resin-impregnated fibers forming the bottom surface of the surfboard.

14. A surfboard including a shaped, rigid-foam core defined by curved side edges that are held in spaced-apart arrangement by a pointed front end and a blunt rear end, said foam core covered with at least one layer of cured resin-impregnated fiber matting and including an elongated recess formed therein for removably anchoring the base of a surfboard fin therein, a shallow draft surfboard fin socket for location in said recess in bonded engagement therewith, comprising:

a) an elongated housing including a narrow bottom wall, spaced-apart upstanding wide side walls, and spaced-apart upstanding narrow front and rear end walls, all joined together along their interconnecting marginal edges to form an elongated cavity configured to receive therein the base of the fin;

b) a flange extending outward from said side and said end walls for location between said top and bottom surfboard surfaces;

c) said housing side and end walls extending above said flange a distance sufficient to locate the upper marginal edges thereof flush with said bottom surface of the surfboard;

d) first and second recesses formed in said front and said rear housing walls respectively, interior said cavity, for receipt therein of a protrusion, formed at the front of the fin base, and a notch, formed at the rear of the fin base, for receipt therein of a clip to hold the fin in said cavity; and, e) a plurality of spaced-apart upwardly directed tooth-shaped protrusions formed in said housing bottom wall for receipt in complemental engagement in a like plurality of spaced-apart indentations formed in the base of the fin to transfer forward and rearward applied stress on the fin to said housing and into the center of the surfboard.

15. The surfboard of claim 14 wherein said flange is planar and is arranged parallel to said bottom surface of said surfboard.

16. The surfboard of claim 14 wherein said upper marginal edges of said side, front and rear housing walls lie flush with the bottom surface of the surfboard and in a plane that is parallel to said bottom surface of said surfboard and further including a cap formed over said upper marginal edges to enclose said cavity formed therein during construction of said surfboard and for later sanding off to open said cavity for receipt therein of the fin base.

17. The surfboard of claim 14 further including at least one rib extending outward between said housing side wall and said flange, exterior of said housing and having a knife edge formed along the free marginal edge thereof for biting into said foam interior of said surfboard to further anchor said housing in said surfboard.

18. The surfboard of claim 14 wherein said second recess includes a notch for receipt therein of the rear terminal end of said fin base and a clip to be interconnected in compact arrangement therein to fix the base of the fin in said housing.

19. In a surfboard of the type including spaced-apart top and bottom surfaces and an elongated recess formed therebetween for removably anchoring the base of a surfboard fin therein, a shallow draft surfboard fin socket for location in said recess in bonded engagement therewith, comprising:

a) an elongated housing including a narrow bottom wall, spaced-apart upstanding wide side walls, and spaced-apart upstanding narrow front and rear end walls, all joined together along their interconnecting marginal edges to form an elongated cavity configured to receive therein the base of the fin;

b) a flange extending outward from said side and end walls for location between the top and bottom surfboard surfaces said flange being planar and arranged parallel to said bottom wall and orthogonal to said housing side walls;

c) said housing side and end walls extending above said flange a distance sufficient to locate the upper marginal edges of said walls above the bottom surface of the surfboard and in a plane that is parallel to the bottom surface of the surfboard;

d) first and second recesses formed in said front and rear housing walls respectively, interior said cavity, for receipt therein of a protrusion, formed at the front of the fin base, and a notch, formed at the rear of the fin base, for receipt therein of a clip to hold the fin in said cavity;

e) further including a cap formed over said upper marginal edges of said housing side, front and rear walls to enclose said cavity formed therein during construction of the surfboard and for later removal to open said cavity for receipt therein of the fin base;

f) further including at least one rib extending outward between said side wall and flange, exterior said housing and having a knife edge formed on the free marginal edge thereof for pressing into the material forming the surfboard to further anchor said housing in the surfboard;

g) wherein said first recess formed in said front housing wall includes a rounded portion to allow said fin base to be inserted into the front of said cavity and pivoted downward into full receipt therein; and, h) wherein said flange is defined by a top surface and a bottom surface and said housing further includes a plurality of depressions formed in said flange top surface for receipt thereover of a layer of curable resin-impregnated fibers forming the bottom surface of the surfboard; and, i) at least one upwardly directed tooth-shaped protrusion formed in said housing bottom wall for receipt in complementary engagement in a notch formed in the base of the fin to transfer forward and rearward applied stress on the fin to said housing and into the center of the surfboard.

20. The surfboard of claim 19 wherein said clip comprises a pair of spaced-apart short arms, each said arm facing in opposite directions, said arms joined together at one end by a slanted long section wherein said one short arm is arranged for insertion in a notch formed in the upper rear part of said fin base while said other short arm is arranged to slip into a notch formed in said lower part of said housing rear end wall.

* * * * *